US012416171B1

(12) United States Patent
Russo

(10) Patent No.: US 12,416,171 B1
(45) Date of Patent: Sep. 16, 2025

(54) EMBEDDED ACCESS ASSEMBLY AND METHOD OF USE

(71) Applicant: Domenic Russo, Dover, MA (US)

(72) Inventor: Domenic Russo, Dover, MA (US)

( * ) Notice: Subject to any disclaimer, the term of this patent is extended or adjusted under 35 U.S.C. 154(b) by 342 days.

(21) Appl. No.: 18/128,873

(22) Filed: Mar. 30, 2023

(51) Int. Cl.
*E04G 21/32* (2006.01)
*E04G 15/06* (2006.01)

(52) U.S. Cl.
CPC ..... *E04G 21/3252* (2013.01); *E04G 15/061* (2013.01)

(58) Field of Classification Search
CPC . F16L 5/00; F16L 5/04; E04G 15/061; H02G 3/26; H02G 3/0406
See application file for complete search history.

(56) References Cited

U.S. PATENT DOCUMENTS 3,265,349 A * 8/1966 Hamrick ..... E04G 15/061 249/177
4,170,853 A * 10/1979 Kohaut ..... E04G 15/061 52/99
4,848,043 A * 7/1989 Harbeke ..... F16L 5/12 137/75
4,850,385 A * 7/1989 Harbeke ..... F16L 5/04 137/75
5,456,050 A * 10/1995 Ward ..... H02G 3/0412 52/220.8
5,573,348 A * 11/1996 Morgan ..... E04C 5/07 588/259
6,173,997 B1 * 1/2001 Nordstrom ..... F16L 5/10 285/422
6,360,502 B1 * 3/2002 Stahl, Jr. ..... A62C 2/065 52/220.8
9,428,900 B2 * 8/2016 Wroblewski ..... E03F 5/0407
10,415,725 B2 * 9/2019 Muenzenberger ... H02G 3/0412
10,596,399 B2 * 3/2020 Muenzenberger ..... E04B 1/947
11,795,706 B2 * 10/2023 Ayers ..... E04F 19/08
2011/0062307 A1 * 3/2011 Currier ..... E04B 5/40 249/1
2012/0233943 A1 * 9/2012 Monden ..... F16L 5/04 52/220.1
2020/0102736 A1 * 4/2020 Cosley ..... A62C 2/065
2021/0234350 A1 * 7/2021 Simon ..... F16L 5/04

* cited by examiner

*Primary Examiner* — Gisele D Ford
(74) *Attorney, Agent, or Firm* — LOEFFLER IP GROUP, P.A.; Bryan L. Loeffler, Esq.

(57) ABSTRACT

An embedded access assembly (1) that may be installed when a raised slab (2) is poured. The embedded access assembly of the present invention provides a temporary safety cover that may be replaced after the raised slab is cured and replaced with a raised upper assembly having a permanent removable cover plate.

2 Claims, 7 Drawing Sheets

EMBEDDED ACCESS ASSEMBLY AND METHOD OF USE

FIELD OF THE INVENTION

This invention relates to the construction of cleanrooms used in high-tech research and manufacturing facilities and, more particularly, to an improved embedded access assembly for use primarily in raised slabs that provide foundational support to assembled cleanrooms.

BACKGROUND OF THE INVENTION

Cleanrooms are engineered spaces wherein the temperature, humidity, cleanliness, concentration of airborne particulates, and air pressure are controlled. These factors make cleanrooms useful in highly technical industries, such as the semiconductor industry, the medical device industry, the pharmaceutical industry, and the nano technology industry.

Many cleanrooms are supported by raised concrete slabs or waffle slabs that create an open "sub-fab" space below the raised slab wherein mechanical, HVAC, and other systems may be placed. However, such equipment still needs to be accessible for supply of services, piping, ductwork and conduit, as well as maintenance and upgrades, thus, open access holes need to be formed and/or cut into the raised slab that then create potential hazards, such as objects falling through open access holes on people working beneath the raised slab. Likewise, people and equipment located on top of the raised slab have the potential of tripping over and/or falling though an access hole, especially during construction.

In new Construction, a common work around solution is laying down two heavy plywood layers in opposing directions after initial concrete cure to cover open access holes while work is completed. After preliminary work is completed, the plywood is removed so one or more protective coatings may be applied to the raised slab, during which time the access holes must remain open. Normal raised slabs have multiple access holes, thereby creating greater opportunities for accidents involving an uncovered access hole to occur.

After a slab is poured, one or more protective coatings are applied to its top surface and open access holes to seal and waterproof the concrete. Conventional covers are then installed over the open access holes with only a single seal created between each conventional cover and the protective coating.

Therefore, a need exists for an embedded access assembly that may be installed when a slab is poured and/or prior to the application of any protective surface coatings to prevent accidents and to provide and additional protective seal around each embedded access assembly.

SUMMARY OF THE INVENTION

The primary object of the present invention is to provide an embedded access assembly that may be installed prior to the application of any protective surface coatings to a raised slab; reduces the time required to prepare a raised slab for installation of a cleanroom; reduces the likelihood of accidents; and provides an additional protective seal around each embedded access assembly.

The present invention fulfills the above and other objects by providing an embedded access assembly having a sleeve that is embedded in a raised slab. The sleeve provides a sleeve flange that rests on an upper surface of the raised slab and provides threaded bolt holes or other attachment points for securing a temporary sleeve cover plate over a top opening of the sleeve. This allows the sleeve flange to be temporarily sealed with the temporary sleeve cover plate while overhead and periphery work is completed and while the raised slab is screeded.

After the temporary sleeve cover plate is removed, an upper assembly having a raised ring and raised ring cover plate is secured to the sleeve flange using bolts. One or more protective coatings may then be applied over the sleeve's flange, the raised ring's flange, and any exposed bolt heads, and up a perimeter wall of the raised ring, thereby adding a protective seal over the whole sleeve flange and raised ring.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
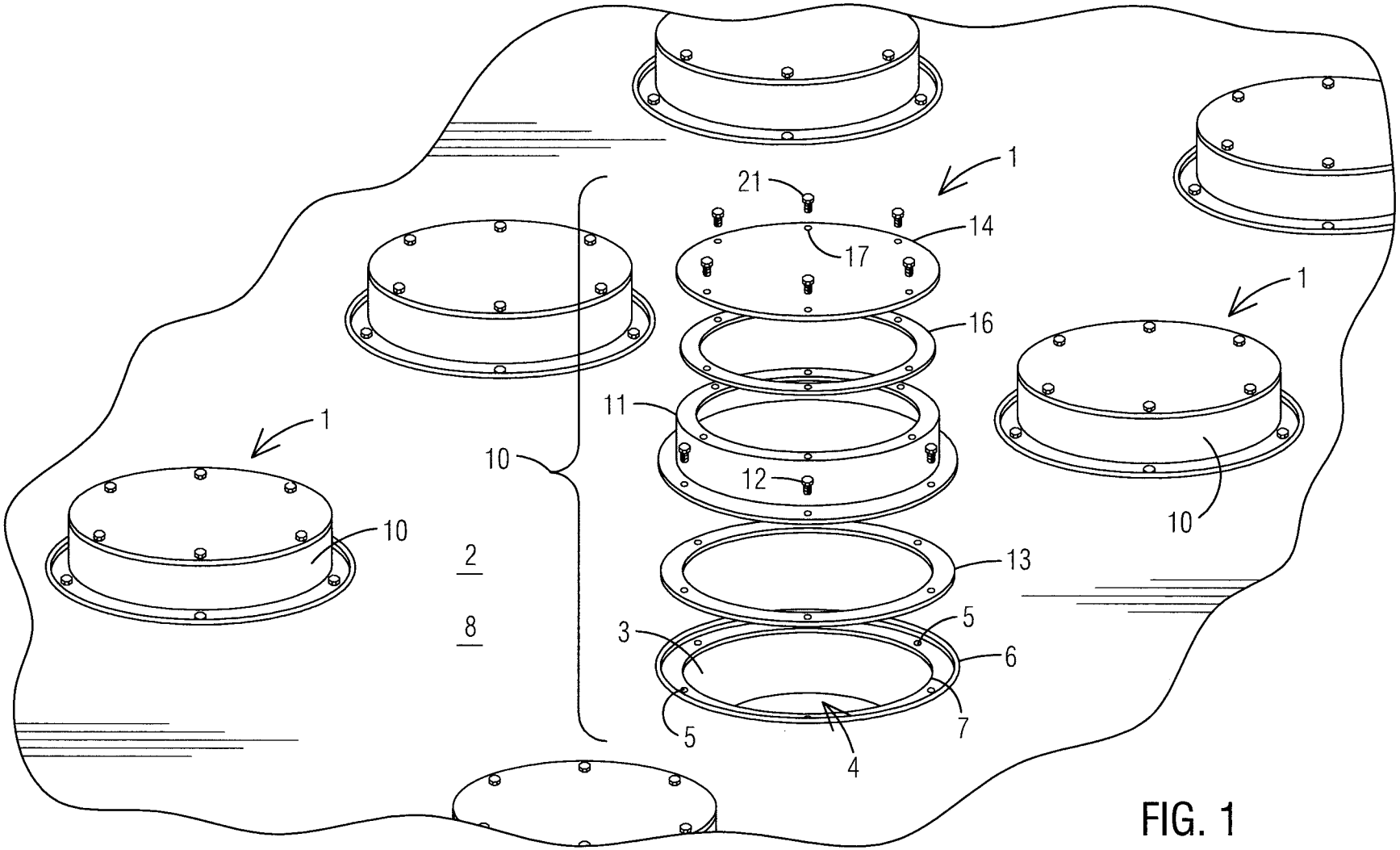
FIG. 1 is a partially exploded top perspective view of a raised slab having a plurality of permanent upper access assembly covers mounted to respective access hole sleeves that are embedded at various locations across a concrete slab.

For purposes of describing the preferred embodiment, the terminology used in reference to the numbered accessories in the drawings is as follows:

1. embedded access assembly, generally
2. slab
3. sleeve
4. sub-fab space
5. lower threaded bolt hole
6. sleeve flange
7. upper edge of sleeve
8. upper surface of slab
9. temporary sleeve cover plate
10. upper assembly
11. raised ring

12. lower bolt
13. lower gasket
14. raised ring cover plate
15. protective surface coating
16. lip
17. upper threaded bolt hole
18. perimeter wall of raised ring
19. raised ring flange
20. lower edge of perimeter wall of raised ring
21. upper bolt
22. upper surface of raised ring
23. imbed tab
24. form
25. threaded center aperture With reference to FIG. 1, a partially exploded top perspective view of a plurality of embedded access assemblies 1 of the present invention installed in a raised slab 2 prior to any application of protective coatings is illustrated. Each embedded access assembly 1 comprises a sleeve 3 embedded in the raised slab 2 that provides a pass-through to an open area or sub-fab space 4 located below the raised slab 2. The sleeve 3 comprises multiple lower threaded bolt holes 5 spaced around a sleeve flange 6 that extends perpendicularly from an upper edge 7 of the sleeve 3 and rests on an upper surface 8 of the raised slab 2.

Figure 2:
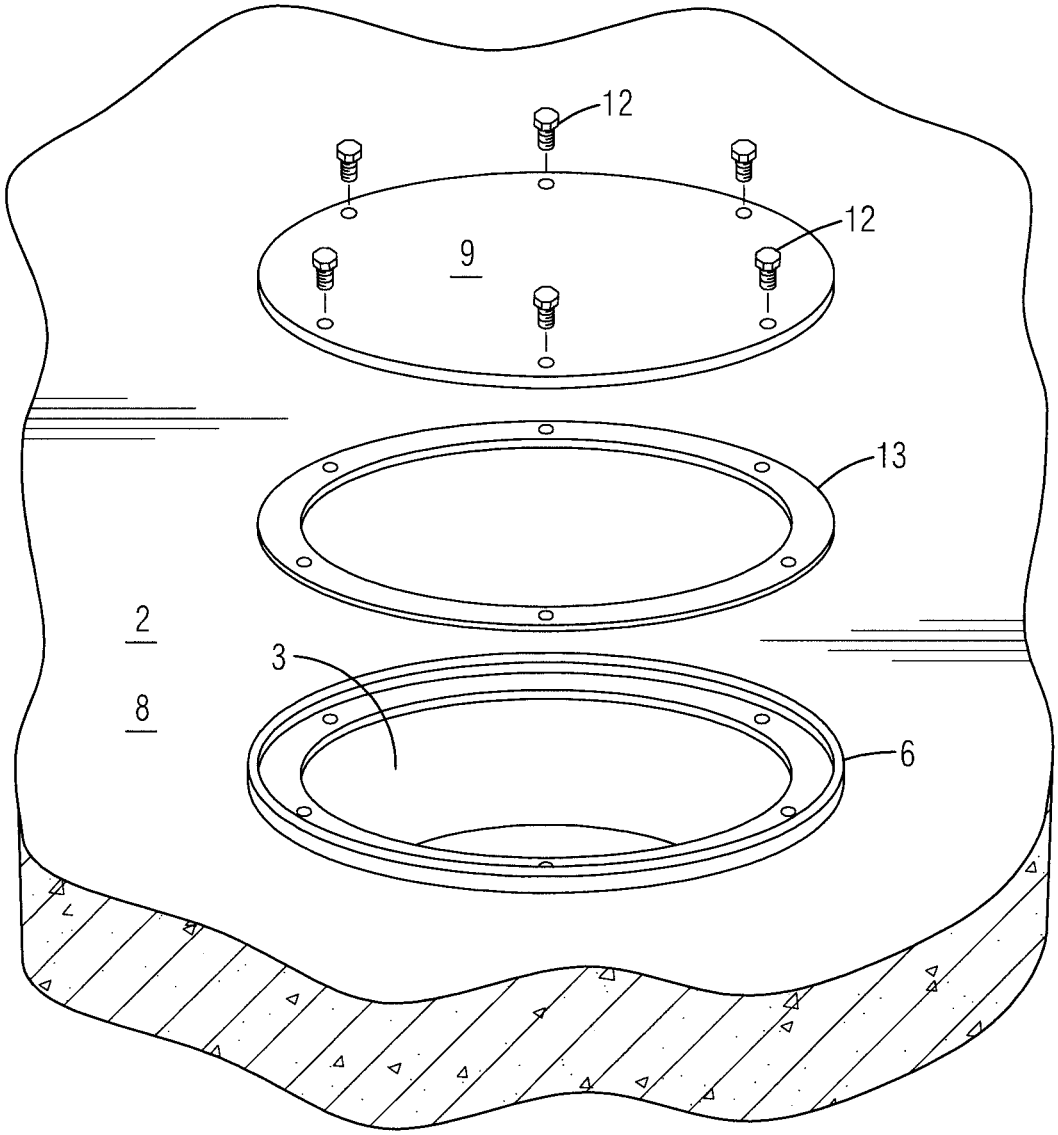
FIG. 2 is a top perspective exploded view of an access assembly cover an access hole sleeve of the present invention.

The sleeve flange 6 and lower threaded bolt holes 5 provide attachment points for securing a temporary sleeve cover plate 9 directly to the sleeve flange 6 during construction, as illustrated in FIG. 2, and/or for securing a permanent upper access assembly 10, as illustrated here in FIG. 1. The permanent upper assembly 10 comprises a raised ring 11 that attaches to the sleeve flange 6 using lower bolts 12 and a lower gasket 13 placed between the raised ring 11 and the sleeve flange 6 that creates a waterproof seal between the two elements. A raised ring cover plate 14 is then secured to the raised ring 11 using upper bolts 15, upper threaded bolt holes and an upper gasket 16 placed between the raised ring 11 and the raised ring cover plate 14 that creates a waterproof seal between the two elements and access through the sleeve 3 when required.

Figure 4A:
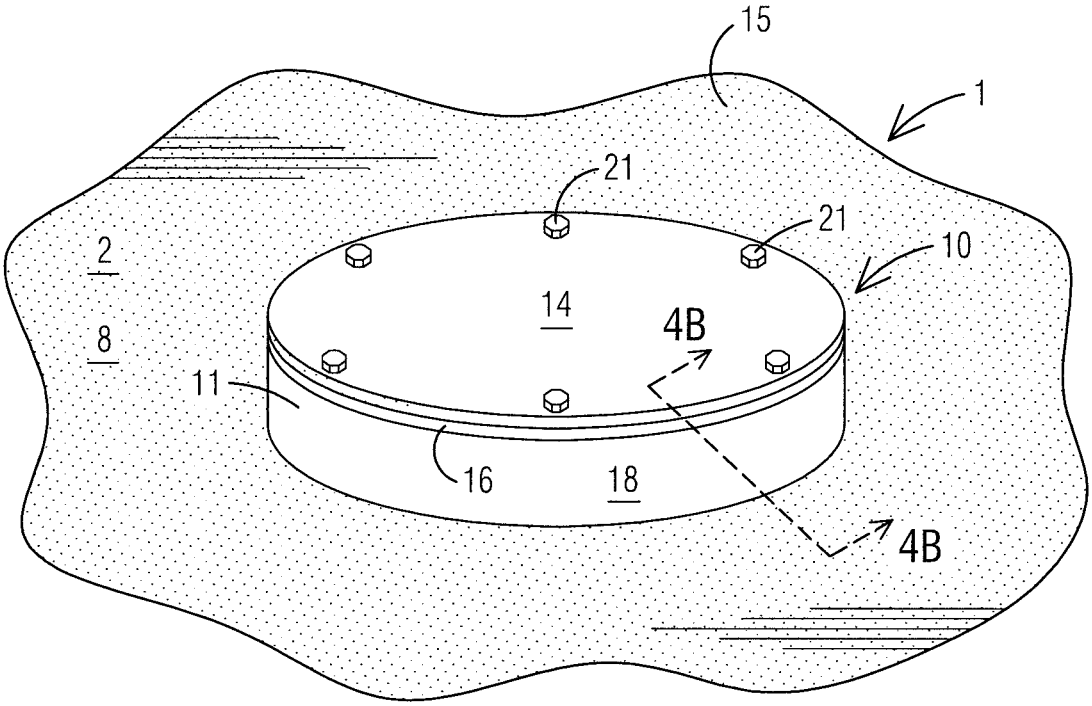
FIG. 4A is a top perspective view of an assembled permanent upper access assembly cover and access hole sleeve of the present invention embedded in a concrete slab subsequent to application of one or more protective surface coatings to the slab.
Figure 4B:
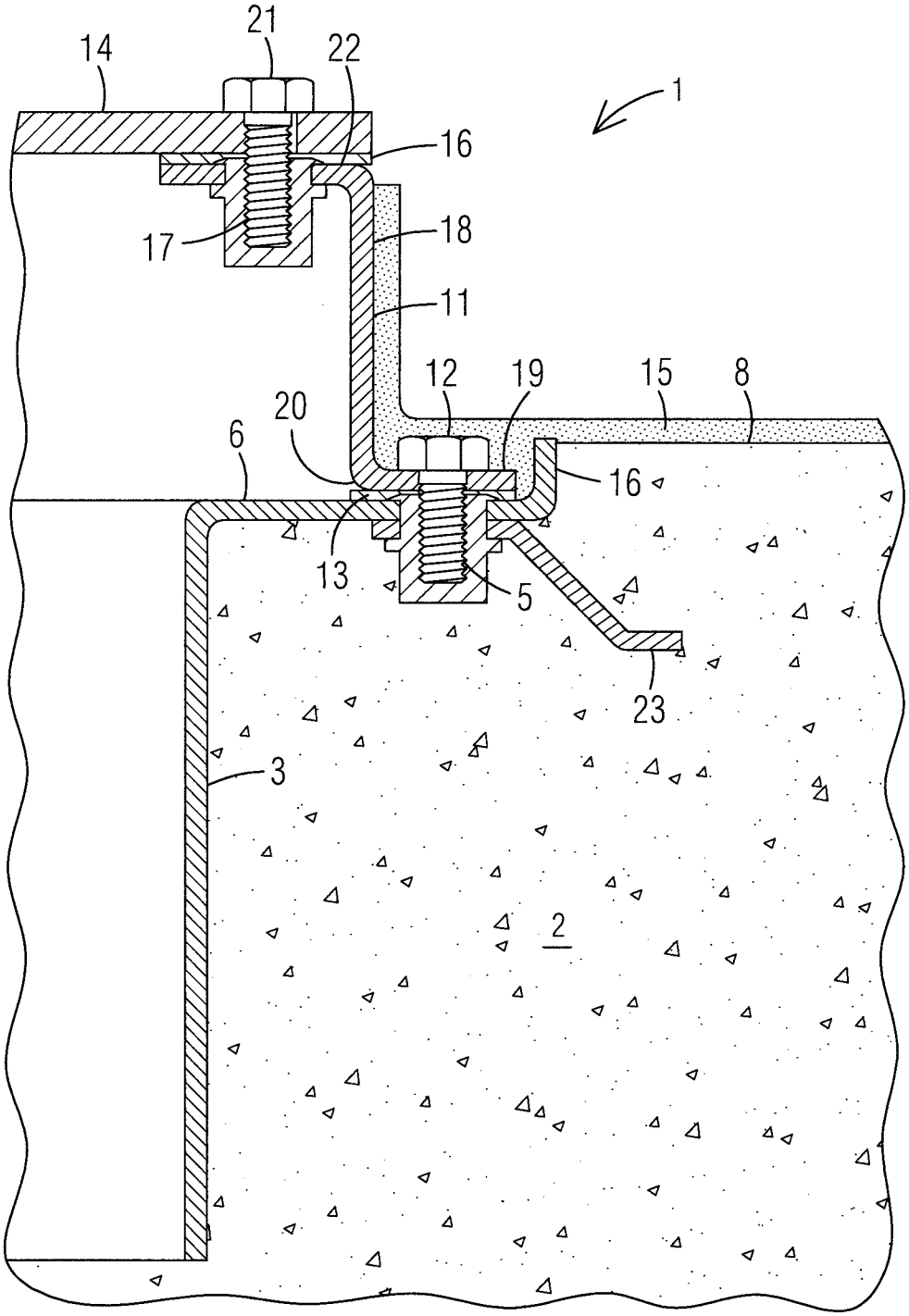
FIG. 4B is a sectional side view of FIG. 4A along lines 4B-4B.

In addition, FIG. 1 further illustrates the sleeve flange 6 and the lower bolts 12 during the installation process prior to being covered with one or more protective coatings that create a waterproof coating and seal between the slab 2 and the sleeve 3 as illustrated in FIGS. 4A and 4B.

With reference to FIG. 2, a top exploded perspective view of a temporary sleeve cover plate 9 and access hole sleeve 3 of the present invention is illustrated. The temporary sleeve cover plate 9 attaches to the sleeve flange 6 using lower bolts 12 and a lower gasket 13 placed between the temporary cover plate 9 and the sleeve flange 6 to create a waterproof seal between the two elements. When assembled, the temporary sleeve cover plate 9 is substantially flush with an upper edge 7 of the sleeve 3 to allow the concrete slab 2 to be poured and screeded flush with the upper edge 7 of the sleeve 3. The temporary sleeve cover plate 9 preferably has countersunk holes for ensuring heads of the lower bolts 12 are substantially flush with an upper edge 7 of the sleeve 3.

After the slab 2 is cured, the temporary sleeve cover plate 9 prevents objects, fluids, and people from falling into and/or through a sleeve 3 and possibly causing injury to objects and other people below the raised slab 2.

Figure 3A:
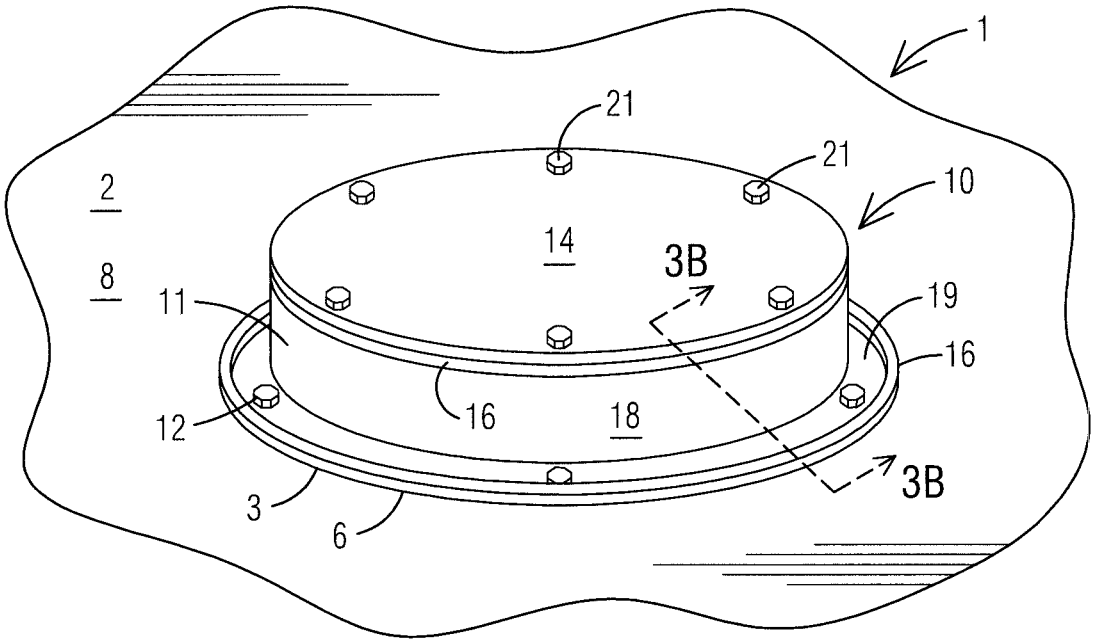
FIG. 3A is a top perspective view of an assembled upper access assembly cover prior to the application of any surface coatings on the slab.
Figure 3B:
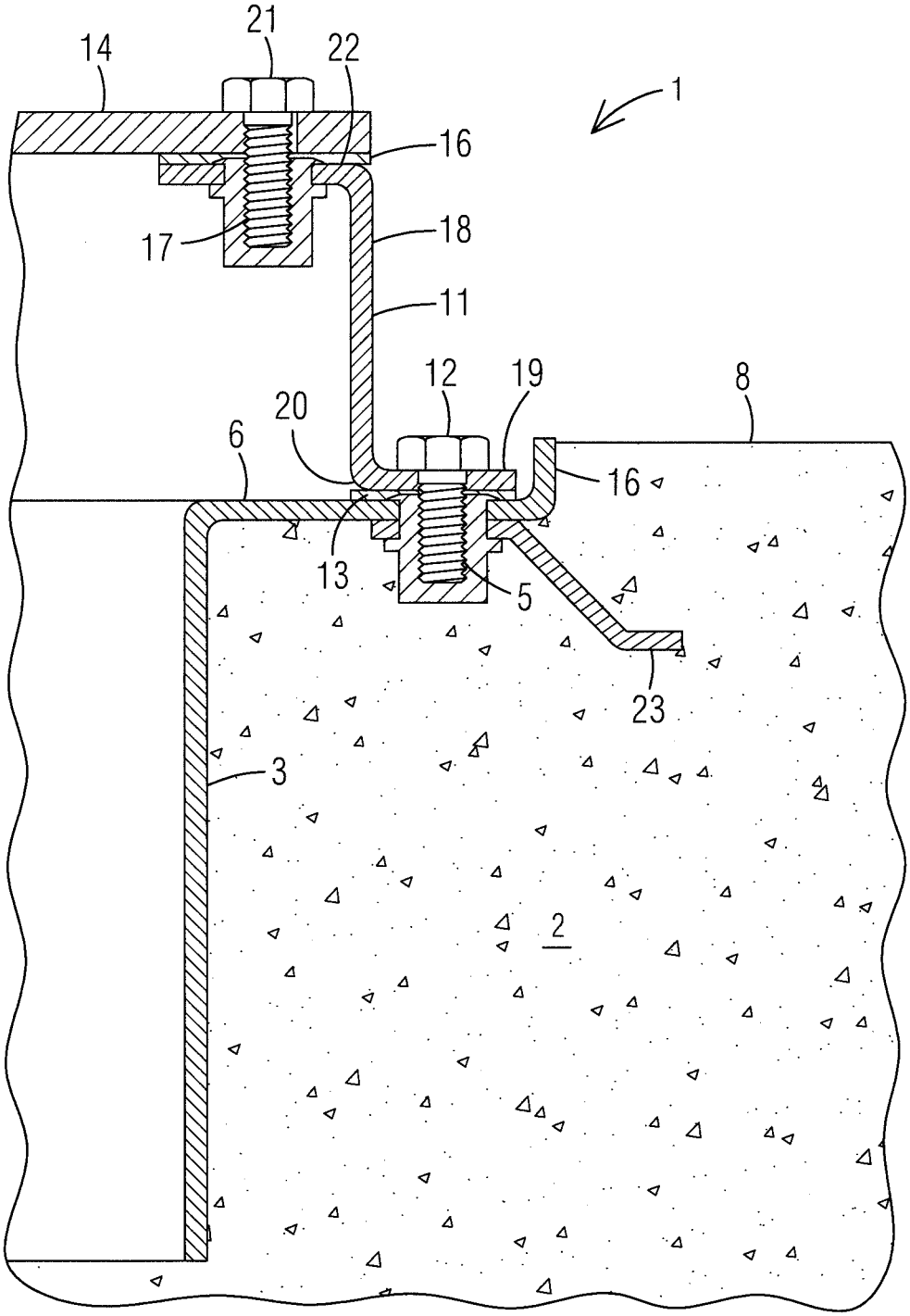
FIG. 3B is a sectional side view of FIG. 3A along lines 3B-3B.

With reference to FIGS. 3A and 3B, a top perspective view and sectional side view, respectively, of an embedded access assembly 1 having an upper access assembly 10, upper assembly cover plate 14 secured to an access embedded access hole sleeve 3 are illustrated. The sleeve 3 and upper access assembly are assembled in a raised slab 2 prior to the application of any protective surface coatings 15 on the raised slab 2. Each embedded access assembly 1 comprises a sleeve 3 embedded in the raised slab 2 that provides a pass-through to an open area or "sub-fab space" 4 located below the raised slab 2. The sleeve 3 comprises multiple threaded bolt holes 5 spaced around a sleeve flange 6 that extends perpendicularly from an upper edge 7 of the sleeve 3 and rests on an upper surface 8 of the raised slab 2. A lip 16 is located around a perimeter edge of the sleeve flange 6.

The upper assembly 10 is made up of a raised ring 11 having a perimeter wall 18 and a raised ring flange 19 that extends perpendicularly from a lower edge 20 of the perimeter wall 18. The raised ring flange 19 attaches to the sleeve flange 6 using lower bolts 12 and a lower gasket 13 that is placed between the raised ring flange 17 and the sleeve flange 6 to create a waterproof seal between the two elements. A raised ring cover plate 14 is then secured to the raised ring 11 using upper bolts 21 that engage upper threaded bolt holes 17 located on an upper surface 22 of the raised ring 11. An upper gasket 16 placed between the raised ring 11 and the raised ring cover plate 14 that creates a waterproof seal between the two elements and access through the sleeve 3 when required.

In addition, FIG. 3B further illustrates the sleeve flange 6 and the lower bolts 12 still exposed during the installation process and prior to being covered up with one or more protective surface coatings 15 that create a waterproof coating and seal between the slab 2 and the sleeve 3 as illustrated further in FIGS. 4A and 4B below. On or more imbed tabs 23 preferably extend from an outer surface of the sleeve 3 to further anchor the sleeve in concrete.

With reference to FIGS. 4A and 4B, a top perspective view and sectional side view, respectively, of an embedded access assembly 1 having an upper access assembly 10, upper assembly cover plate 14, and access hole sleeve 3 of the present invention embedded in a raised slab 2 after the application of one or more protective surface coatings 15 are illustrated. Each embedded access assembly 1 comprises a sleeve 3 embedded in the raised slab 2 that provides a pass-through to an open area or "sub-fab space" 4 located below the raised slab 2. The sleeve 3 comprises multiple threaded bolt holes 5 spaced around a sleeve flange 6 that extends perpendicularly from an upper edge 7 of the sleeve 3 and rests on an upper surface 8 of the raised slab 2. The raised ring flange 19 attaches to the sleeve flange 6 using lower bolts 12 and a lower gasket 13 that is placed between the raised ring flange 17 and the sleeve flange 6 to create a waterproof seal between the two elements. A raised ring cover plate 14 is then secured to the raised ring 11 using upper bolts 21 that engage upper threaded bolt holes located on an upper surface 22 of the raised ring 11. An upper gasket 16 placed between the raised ring 11 and the raised ring cover plate 14 that creates a waterproof seal between the two elements and access through the sleeve 3 when required.

As illustrated herein, one or more protective surface coatings 15 have been applied to cover the slab 2, the sleeve flange 6, and the raised ring flange 17, to create a waterproof seal.

Figure 5:
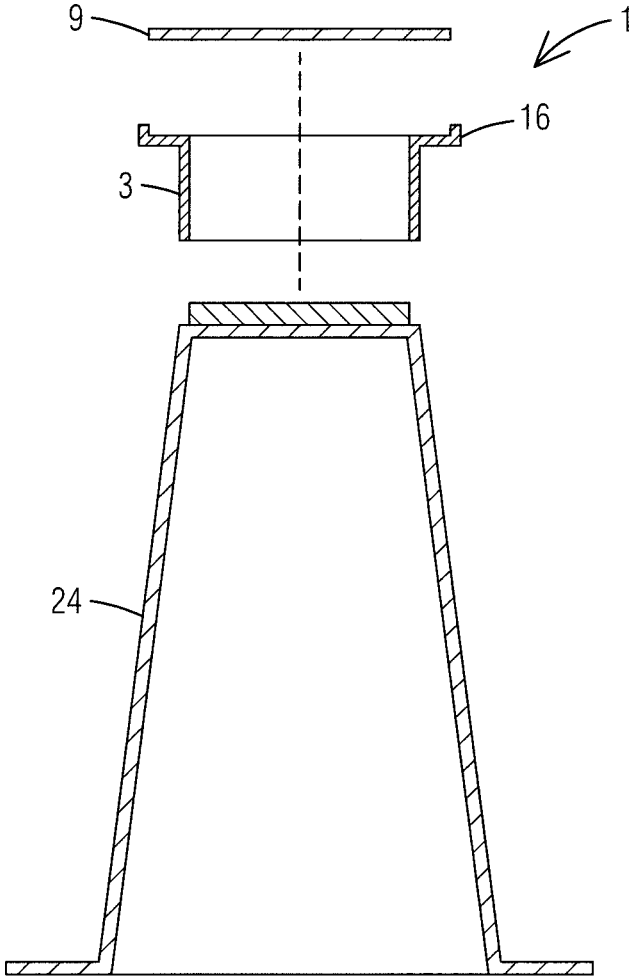
FIG. 5 is side sectional view of an assembly of the present invention with concrete formwork prior to a slab being poured.

With reference to FIG. 5, an exemplary side exploded perspective view of an assembly 1 of the present invention prior to a slab 2 being poured. Prior to a slab 2 being poured, protective sleeves 3 are coupled to concrete forms 24, thereby allowing concrete to be poured around the forms 24 and sleeves 3. The temporary sleeve cover plate 9 protects the sleeve 3 while allowing the concrete slab 2 to be screeded perfectly level with lip 16 of the sleeve 3; and then to have one or more protective coatings applied to the concrete 2 without fear of damages or accidents involved with conventional open access holes.

Figure 6:
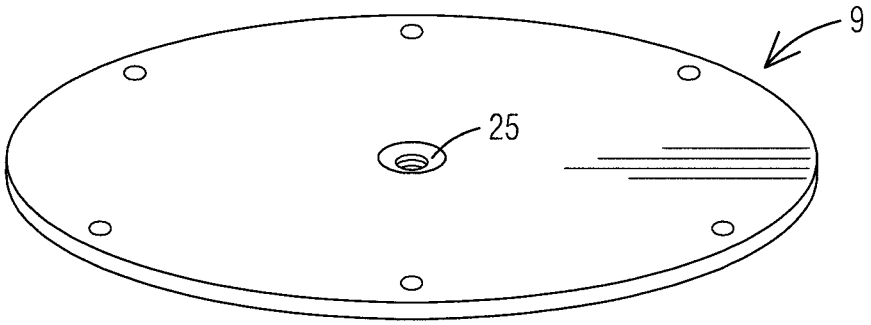
FIG. 6 is a top perspective view of a temporary sleeve cover plate having a threaded center aperture.

Finally, with reference to FIG. 6, a top perspective view of a temporary sleeve cover plate 9 having a threaded center aperture 25 is illustrated. The threaded center aperture 25 is preferably recessed within a depression to allow a countersunk fastener to be attached from the top and into a corresponding threaded aperture in a form 24 below to ensure a tight connection between sleeve 3 and the form 24.

In addition, the threaded center aperture 25 provides an attachment point for securing an air hose fitting and air hose directly to the temporary sleeve cover plate 9. This allows compressed air to be used to blow out and remove any form-work that is stuck after the concrete slab cures.

The threaded center aperture 25 may also be used to lift the temporary sleeve cover plate 9 by attaching a threaded rod or bolt thereto when the temporary sleeve cover plate 9 becomes stuck by excess concrete.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. An embedded access assembly primarily for use is raised slabs, said embedded access assembly comprising:

a tubular-shaped sleeve having an upper edge with a sleeve flange extending perpendicularly from the upper edge of the tubular-shaped sleeve;

a plurality of lower threaded bolt holes spaced apart on said sleeve flange;

a lip extending upward from a perimeter edge of the sleeve flange;

at least one imbed tab extending at a downward angle from the sleeve flange;

a temporary sleeve cover plate being removeably attachable to said sleeve flange;

a permanent upper assembly secured to the sleeve and sleeve flange;

said permanent upper assembly comprises a raised ring having a perimeter wall and a raised ring flange extending perpendicularly from a lower edge of the perimeter wall wherein said raised ring flange attaches directly to said sleeve flange; and a raised ring cover plate secured to the raised ring.

2. A method for embedding an access assembly in a raised slab, said method comprising:

pouring concrete around a tubular-shaped sleeve having an upper edge with a sleeve flange extending perpendicularly from the upper edge of the tubular-shaped sleeve;

a lip extending upward from a perimeter edge of the sleeve flange to prevent concrete from covering the sleeve flange;

securing a temporary sleeve cover plate to said sleeve flange to prevent debris from entering the sleeve;

pouring said concrete around one or more imbed tabs wherein the one or more imbed tabs extend at a downward angle from the sleeve flange to further anchor the tubular-shaped sleeve within the concrete;

removing the temporary sleeve cover plate and securing an upper assembly to the sleeve flange wherein said upper assembly comprises a raised ring having a perimeter wall and a raised ring flange extending perpendicularly from a lower edge of the perimeter wall;

securing a raised ring cover plate to the raised ring; and applying a protective surface coating over said concrete, said lip, said sleeve flange and said raised ring flange.

* * * * *